US006601349B1

(12) United States Patent
Corden

(10) Patent No.: US 6,601,349 B1
(45) Date of Patent: Aug. 5, 2003

(54) FREE-STANDING PANEL WALL SYSTEM

(76) Inventor: David A. Corden, P.O. Box 23964, Knoxville, TN (US) 37933

( * ) Notice: Subject to any disclaimer, the term of this patent is extended or adjusted under 35 U.S.C. 154(b) by 34 days.

(21) Appl. No.: 10/001,110

(22) Filed: Nov. 2, 2001

(51) Int. Cl.[7] ..... E04B 2/78

(52) U.S. Cl. ..... 52/36.5; 52/126.4; 52/241; 52/762; 52/780; 52/781

(58) Field of Search ..... 52/241, 242, 481.2, 52/762, 780, 781, 656.1, 220.7, 238.1, 243, 481.1, 479, 483.1, 489.1, 489.2, 239, 36.4, 36.5, 36.6, 126.4

(56) References Cited

U.S. PATENT DOCUMENTS

| | | | | | |
|---|---|---|---|---|---|
| 2,037,889 | A | * | 4/1936 | Doud | 52/781 |
| 4,034,463 | A | * | 7/1977 | Ryan | 52/239 |
| 4,118,903 | A | * | 10/1978 | Coulthard | 52/239 |
| 4,370,838 | A | | 2/1983 | Vermillion | |
| 4,459,790 | A | | 7/1984 | Vermillion | |
| 4,651,484 | A | * | 3/1987 | Rutkowski | 52/241 |
| 4,991,368 | A | * | 2/1991 | Amstutz | 52/241 |
| 5,216,859 | A | * | 6/1993 | Moreno et al. | 52/238.1 |
| 5,341,615 | A | * | 8/1994 | Hodges et al. | 52/220.7 |
| 5,440,854 | A | * | 8/1995 | Hohmann | 52/489.1 |
| 5,791,093 | A | | 8/1998 | Diamond | |
| 6,115,977 | A | | 9/2000 | Hornberger et al. | |
| 6,226,947 | B1 | * | 5/2001 | Bado et al. | 52/483.1 |
| 6,425,219 | B1 | * | 7/2002 | Barmak et al. | 52/239 |

* cited by examiner

*Primary Examiner*—Michael Safavi

(74) *Attorney, Agent, or Firm*—Pitts & Brittian, P.C.

(57) ABSTRACT

A free-standing panel wall system which includes at least an elongated floor rail and an elongated top rail, each of a generally U-shaped cross section, and first and second sets of upright standards of generally U-shaped cross-section and having respective side wings that project laterally from the standard, there being one set of standards releasably secured at their top and bottom ends on respective ones of the opposite side webs of the floor rail and top rail. At spaced apart locations intermediate the floor and top rails and disposed between the standards of the first and second sets of standards there is provided a plurality of horizontal connectors, each of which is removably secured to respective ones of the standards on the opposite sides of the horizontal connectors. In one embodiment, there is provided one or more wall system sections which extend generally laterally of the plane of the main wall system section. Angled bracket connectors are provided at least at the intersection of the top and bottom rails of the main wall system section and the top and bottom rails of a lateral wall system section. Each standard is provided with one or more lugs projecting laterally from each of its side webs. At least one panel member is provided which is dimensioned to be received between adjacent ones of the standards. Each side of the panel is provided with lugs which project rearwardly of the panel and are adapted to interlockingly engage respective ones of the lugs on adjacent ones of the standards to thereby removably mount the panel between the standards. The present panel wall system is anchored to the floor of a retail establishment, for example, and is self-supporting without being anchored to either the ceiling or wall of the establishment. Preferably, the materials of construction of the present panel wall system are either fire-resistant or fireproof.

12 Claims, 7 Drawing Sheets

FREE-STANDING PANEL WALL SYSTEM

FIELD OF THE INVENTION

This invention relates to panel wall systems of the type commonly employed for the display of merchandise in retail establishments.

BACKGROUND OF THE INVENTION

Commonly, panel wall systems comprise horizontal stringers or channels which are secured to the interior wall of a retail establishment, vertical standards which are secured to the stringers, and planar panels which are secured to the standards. This structure provides the background for the display of merchandise which is exhibited on shelves that are supported by brackets that are mounted on, and which project outwardly from, the panel wall system.

It is frequently desired that a panel wall system be free-standing, that is, the system is not anchored to either the ceiling or the wall of the retail establishment so that the system may be relocated within the establishment without reference to the walls of the establishment. Thus, in free-standing panel wall systems, the system rests on the floor of the establishment. In certain prior art instances, the system is retained against tipping by the structural design of the system, such as through the means of horizontal legs that are attached to the bottom of the panel wall system and which project laterally from the wall system to provide lateral "anti-tipping" support to the wall system. Such structural members present obstacles to the flow of customer traffic, including the possibility of customers tripping over the lateral projections. In other instances, the panel wall system may be stabilized against tipping over by embedding relatively large and strong posts in the floor of the establishment such that these posts extend upwardly from the floor and serve to anchor the wall system to the floor. This concept is frequently employed when the floor of the establishment comprises concrete. This concept for stabilizing the wall system against tipping requires destructive modification of the floor, is expensive to install and otherwise tends to inhibit relocation of the wall system, a most undesired result.

Free-standing panel wall systems desirably provide for the display of merchandise on shelves which are provided on both the front and rear sides of the wall system. This desired feature of the wall system requires that the panel wall system provide for the support of shelving on both the front and rear upright faces of the system. This desirable feature imposes upon a free-standing wall system the need for enhanced strength to provide stable support of merchandise that rests on shelves that are cantilevered from the opposite surfaces of the wall system. Notably, the overall weight of the merchandise displayed on the shelves on the front surface of the wall system may not be, and frequently is not, of the same or nearly the same, overall weight as the merchandise displayed on the shelves on the rear surface of the wall system. Thus, this factor imposes an even more demanding requirement relative to the strength and stability of a free-standing panel wall system.

Further, known prior art free-standing panel wall systems are constructed of materials which are not fireproof or fire-resistant, partly due to the difficulty of initially installing and subsequent dismantling of the system for movement to a new location within the establishment and again installing the system at its new location.

These and other requirements of a free-standing panel wall system are met, and/or exceeded, by the present invention.

SUMMARY OF THE INVENTION

The present invention comprises a free-standing panel wall system which includes at least an elongated floor rail and an elongated top rail, each of a generally U-shaped cross section, and first and second sets of upright standards of generally U-shaped cross-section and having respective side wings that project laterally from the standard, there being one set of standards releasably secured on each of the opposite sides of the floor rail and top rail. The opposite ends of the standards are removably attached to respective ones of the floor and top rails. At spaced apart locations intermediate the floor and top rails and disposed between the standards of the first and second sets of standards there is provided a plurality of horizontal connectors, each of which is removably secured to respective ones of the standards on the opposite sides of the horizontal connectors. In one embodiment, there is provided one or more wall system sections which extend generally laterally of the plane of the main wall system section. Angled bracket connectors are provided at least at the intersection of the top and bottom rails of the main wall system section and the top and bottom rails of a lateral wall system section. The ends of the horizontal connectors of the main wall section are removably joined to respective ones of the horizontal connectors of a lateral wall section in like manner employing bracket connectors. Each standard is provided with one or more lugs projecting laterally from each of its side webs. At least one panel member is provided which is dimensioned to be received between adjacent ones of the standards. Each side of the panel is provided with lugs which project rearwardly of the panel and are adapted to interlockingly engage respective ones of the lugs on adjacent ones of the standards to thereby removably mount the panel between the standards. The present panel wall system may be anchored to the floor of a retail establishment, for example, and is self-supporting without being anchored to either the ceiling or wall of the establishment. In certain embodiments, no anchoring of any kind is required. Preferably, the materials of construction of the present panel wall system are either fire-resistant or fireproof. Cold rolled steel is a suitable construction material for the components of the present panel wall system.

DETAILED DESCRIPTION OF THE INVENTION

Figure 1:
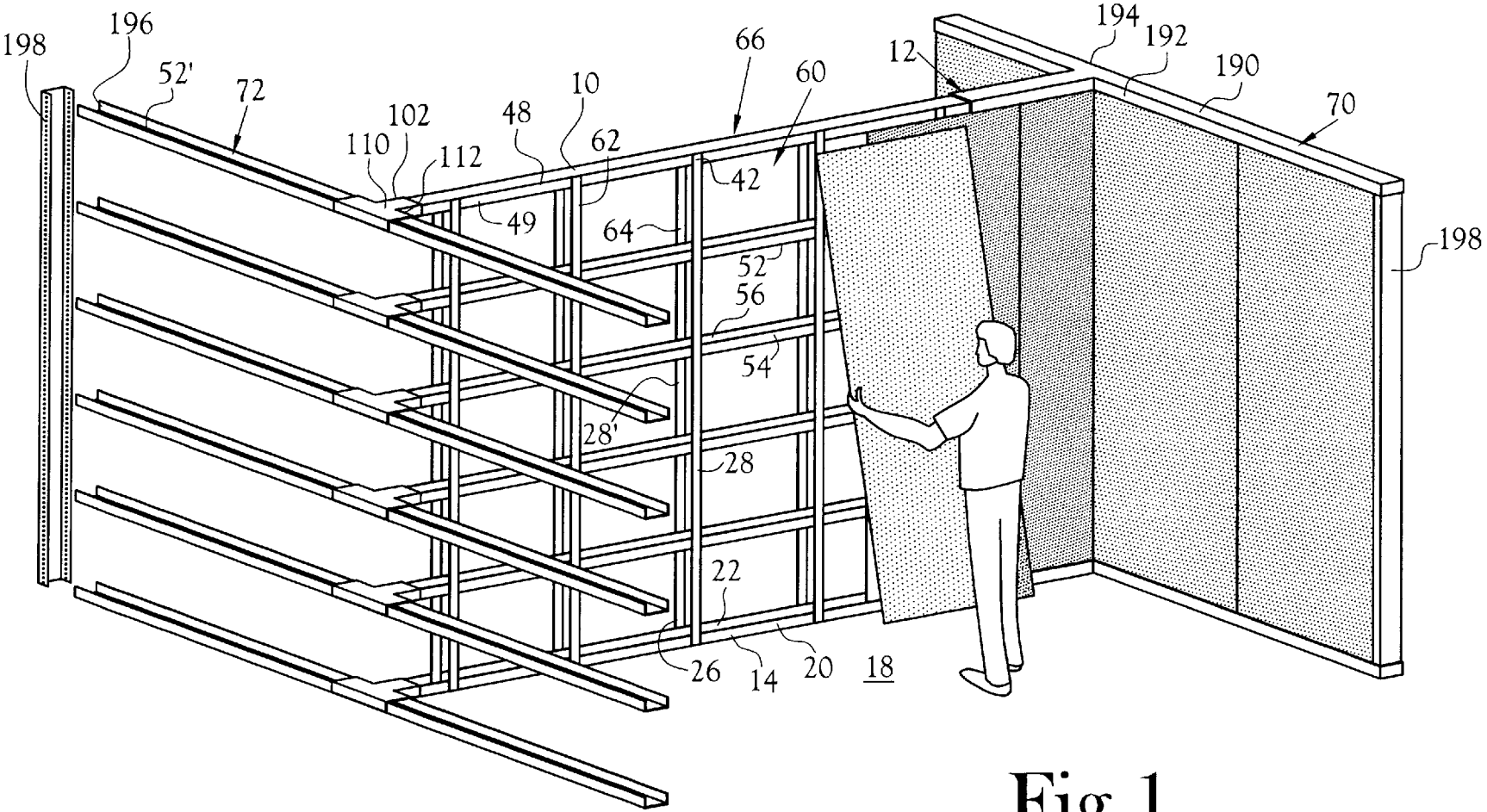
FIG. 1 is a representation of one embodiment of a free-standing panel wall embodying various of the features of the present invention.
Figure 5:
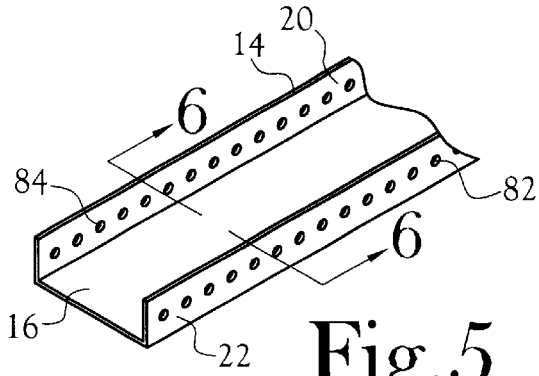
FIG. 5 is a representation of a portion of an elongated horizontal connector suitable for use in the present invention.
Figure 6:
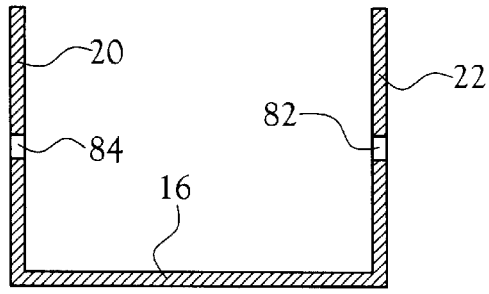
FIG. 6 is a cross-sectional view of the horizontal connector depicted in FIG. 5 and taken generally along the line 6—6 of FIG. 5.
Figure 7:
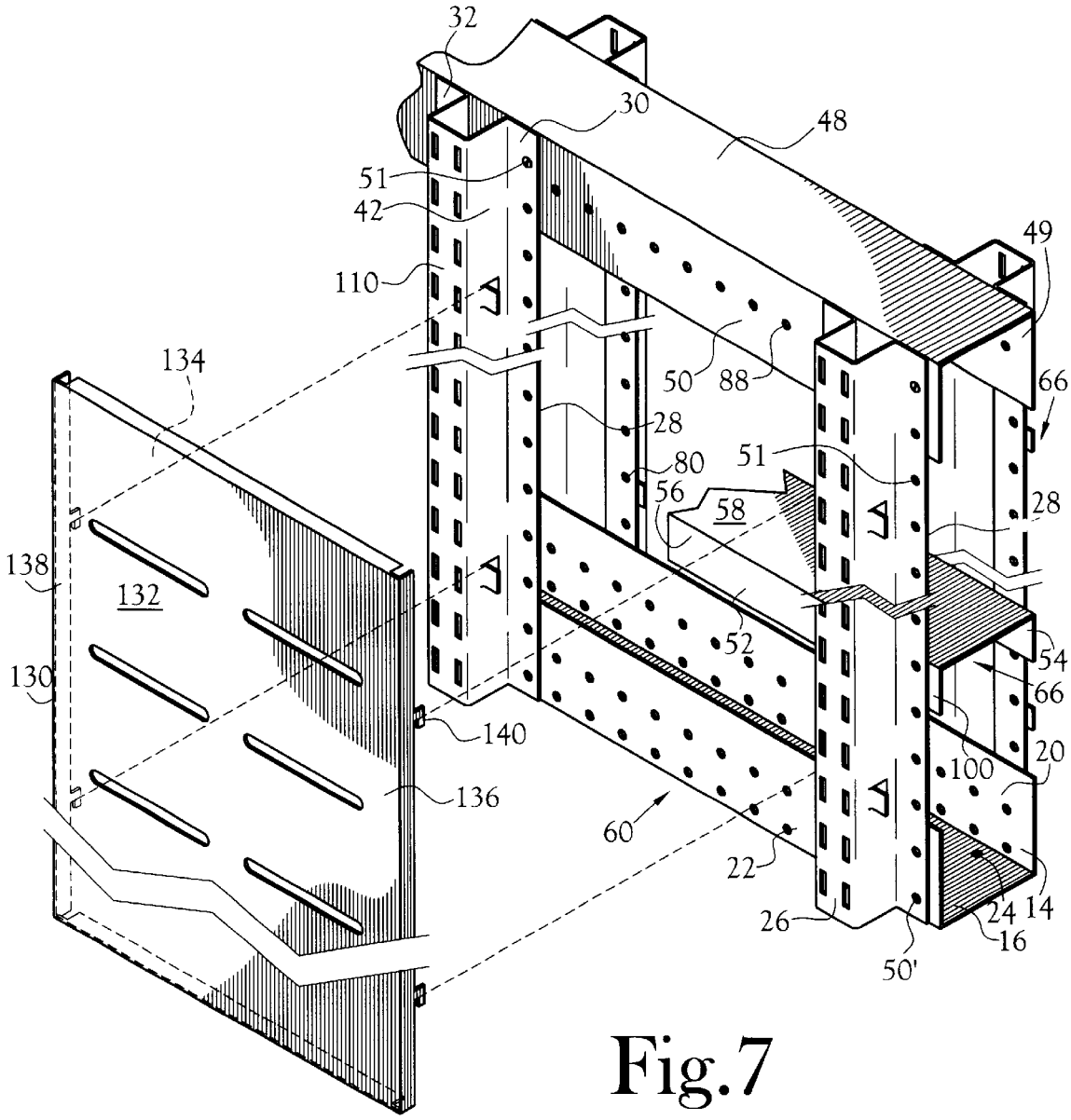
FIG. 7 is a representation, partly exploded, of a portion of a panel wall system embodying various of the features of the present invention and depicting a panel member and its mounting between adjacent standards.

Referring initially to FIGS. 1, 5 and 7, in accordance with one embodiment of the present invention, there is provided a free-standing panel wall system 12 which is both strong and stable. A main section 10 of the present system comprises at least one rigid U-shaped (in cross section) floor rail 14, the face web 16 of which lies flat on, and is anchored to, the floor 18 of an establishment with its opposite side webs 20,22 projecting upwardly from the floor. The width of the face web of the floor rail is chosen to provide for the placement of floor anchors 24 spaced apart laterally on the face web to provide laterally spaced apart points of anchoring of the floor rail to the floor. In other embodiments of the present panel wall system, no anchoring of the wall system to the floor is required.

At spaced apart locations along the length of the floor rail, there are received the bottom ends 26 of a plurality of rigid wall standards 28, (see FIGS. 2 and 3) each being of a U-shaped cross section, and including generally planar wings 30,32 which extend laterally from the distal edges 34,36 of each of the side webs 38,40 of the standard and provided with holes 50 through the thickness thereof and spaced uniformly and equally spaced apart along the length of each wing. The opposite lateral wings 30,32 of each standard are disposed externally of the floor rail and are disposed alongside and substantially parallel to the plane of their respective one of the upstanding side webs 20,22 of the floor rail. These bottom ends 26 of the standards are releasably anchored to respective the one of side webs 20,22 of the floor rail as by screws or other suitable removable fastener 51 which passed through registered ones of the holes 50 in the wings of the standard and the holes 50' through the thickness of the side webs of the floor rail. The top ends 42 of the standards 28 are likewise disposed externally of the side webs 44,46 of a top rail 48 which is U-shaped in cross section with opposite side webs 49,50 like the floor rail, but with its side webs 48,50 projecting downwardly of the wall system. The top ends 42 the standards 28 are releasably anchored to a side web of the top rail as by screws, bolts or other suitable releaseable fasteners 51'. In a preferred embodiment of the present invention there is provided on the front face 60 of the main wall section 10 a plurality of standards 28 which comprises a first set 62 of standards. A second set 64 of like standards made up of standards 28' is provided on the rear face 66 of the main wall section.

At locations intermediate the floor and top rails, the present wall system includes a plurality of horizontal connector rails 52, each of which is of a U-shaped cross section, substantially the same in shape and size as the cross section of the floor rail 14. The side webs 54,56 of each horizontal connector rail 52 may be oriented either upwardly or downwardly from the face web 58 of the horizontal connector, but in any event, each horizontal connector is interposed between the first set of standards 28 on the front face 60 of the wall system and the second set of standards 28' on the rear face of the wall system, the standards preferably being disposed directly across the wall system from one another. Each side web 54,56 of each horizontal connector rail 52 is disposed in substantially planar relationship to the planar wings of its associated front and rear standards, and each is releasably anchored to at least one, and prefereably both, of the planar wings of each of these standards. This interlocking relationship between the plurality of standards of a wall system and the plurality of horizontal connectors is repeated substantially throughout the present wall system, thereby rendering the wall system exceptionally rigid and resistive to warping or to tilting to the left or right within its plane, as viewed in a front plan view thereof.

By reason of the U-shaped cross section of each horizontal connector rail, at least two of these connector rails may be combined as by nesting or by inverting one connector rail and overlapping onto a further rail, as desired to enhance the horizontal support strength of the wall system and/or to permit greater separation distances between adjacent standard. These combined rails may be fastened to one another and/or to the standards. Still further, the telescopically combined rails may be extended or shortened to shorten or lengthen the wall section without full disassembly of the wall section.

For purposes of establishing modularity and ease of installation, in the present invention each of the planar wings 30,32 of each standard and each of the side webs of each of the floor rail, the top rail and the horizontal connector is provided with holes 80,82,84,86,88,90. respectively, through their respective thickness at equally and uniformly spaced apart locations along the length of each such member. For example, holes may be provided one inch on centers along the length of each of the floor rail, top rail, horizontal standard and like-spaced holes may be provided in each of the planar wings 30,32 of each standard 22,28. When a hole in or near the bottom end of a standard is in register with a hole in the side web of a floor rail, for example, a screw or bolt or other suitable releaseable fastener may be threaded through the registered holes to interconnect the bottom end of the standard to the floor rail. In like manner the intersections 100 (typical) of the standards and horizontal connectors may be interconnected employing a removable fastener that is disposed within registering holes in the standards and horizontal connectors. Obviously the top rail of the present wall system can be interconnected to the top ends of the standards of the system in like manner.

Whereas the panel wall system of the present invention may reside in a single plane, i.e, there are no supporting lateral projections therefrom, in one embodiment, the so-constructed main section 10 of the wall system of the present invention may include one or more laterally extending sections 70,72. (FIG. 1) For example, a section of the wall system may extend laterally from the main wall section at substantially any location along the length of the main section, and/or from one or both the front and rear faces of the main wall section. That is, one or more lateral sections may be provided at either or both ends of the main section and/or at one or more locations intermediate the opposite ends of the main section.

Figure 9:
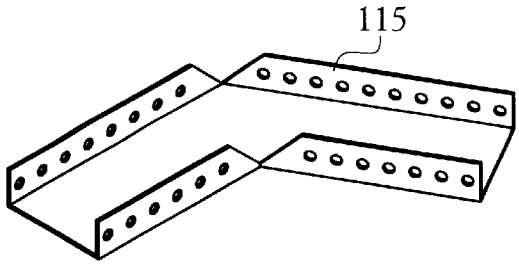
FIG. 9 is a representation of a 135 degree, 2-way, angled bracket connector useful in the present invention.
Figure 10:
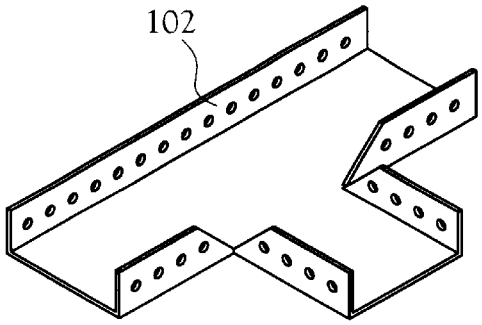
FIG. 10 is a representation of a 90 degree, 3-way, angled bracket connector useful in the present invention.
Figure 11:
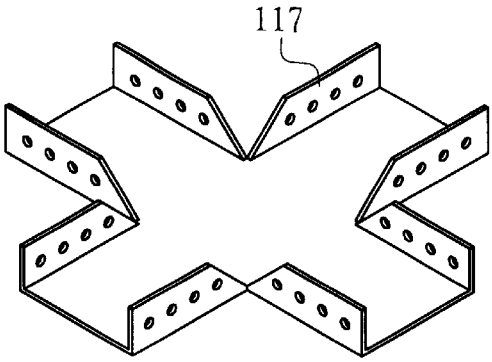
FIG. 11 is a representation of a 90 degree, 4-way, angled bracket connector useful in the present invention.
Figure 12:
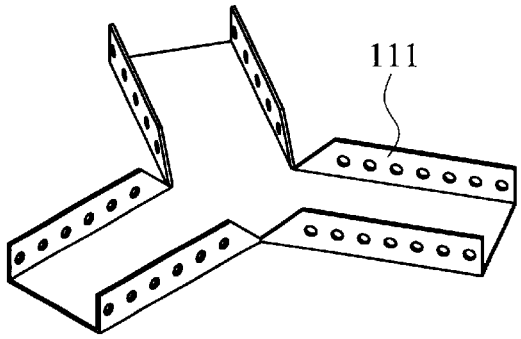
FIG. 12 is a representation of a 120 degree, 3-way, angled bracket connector useful in the present invention.
Figure 8:
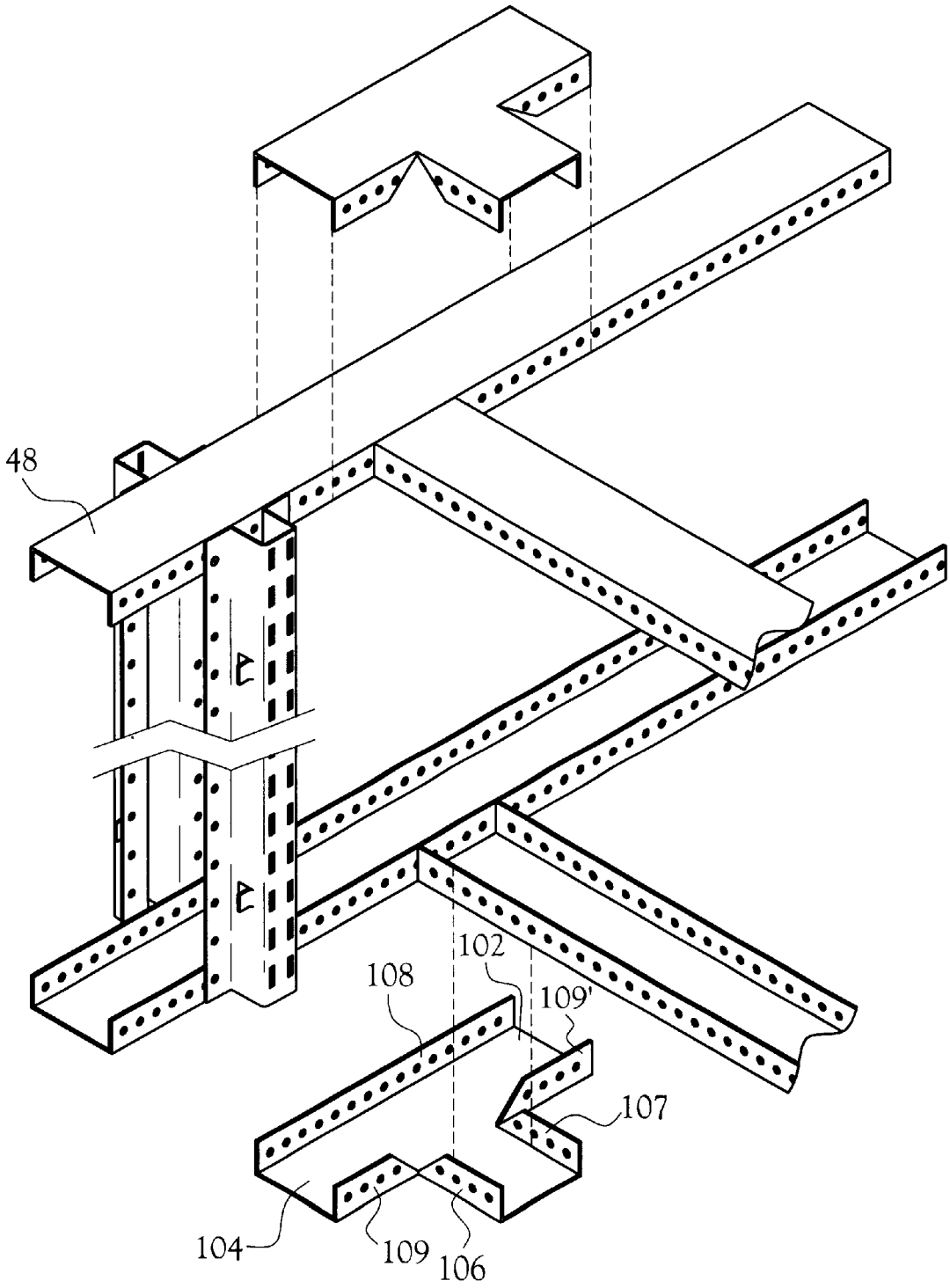
FIG. 8 is a representation of a portion of a panel wall system of the present invention and depicting the mounting of angled bracket connectors at the top and bottom edges of one embodiment of the present invention.
Figure 13:
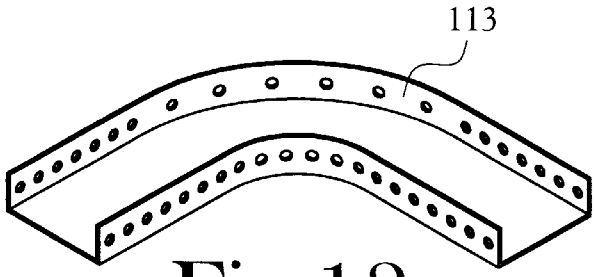
FIG. 13 is a representation of a curved bracket connector useful in the present invention.

At those locations along the main section of the present wall system where a lateral section is to be placed, the lateral section may be made up in the form of a "main " section as described hereinabove, and thereafter attached to the main section employing angled bracket connectors. A typical angle bracket connector 102 (FIG. 8) has a face web 104 which is of a T-shaped geometry and is of a U-shaped cross section. Side webs 106, 107,108,109 and 109' project substantially perpendicularly from each of the side margins of the connector, each side web having a plurality of holes through the thickness thereof at equally and uniformly spaced apart locations along each side web in the same manner as a horizontal connector 52 of the main wall section. This angle bracket connector is fitted over and about the intersection 110 of the top rail 48 of a main section of the present wall system and over and about the abutting portion 112 of the top rail 48' of a lateral section 72 of the present wall system, thereby providing for registration of holes in the side webs of the bracket connector with holes in the side webs of the top rails of the main and lateral sections. Again, screws or bolts threaded through the registering holes provides for removably interconnection and rigid securement of a lateral section to the main section of the present wall system. For removably securing lateral sections to the main section of the present wall system at angles of other than ninety degrees, angle brackets of other geometries, such as 135-degree angled 115 (or other degree of angle), Y-shaped 113, or curved, etc. as depicted in FIGS. 9,12 and 13 may be employed as needed. Other suitable bracket configurations will be recognized by one skilled in the art such as a 90 degree, 4-way bracket 117 as depicted in FIG. 11. It will be noted that these angled bracket connectors provide material rigidity to the present wall system in multiple directions, thereby materially contributing to the lack of need in the present wall system for anchoring of the present wall system to either the floor, ceiling or a wall of the establishment. Moreover, this stabilizing effect is enhanced by providing an angled bracket connector at the juncture of the end of each horizontal connector and a corresponding horizontal connector associated with a lateral wall section located at an end of the main wall section as depicted in FIG. 1. This same desirable effect is obtained when employing the present bracket connectors to attach a lateral wall section to the main wall section at a location intermediate the opposite ends of the main wall section.

Figure 2:
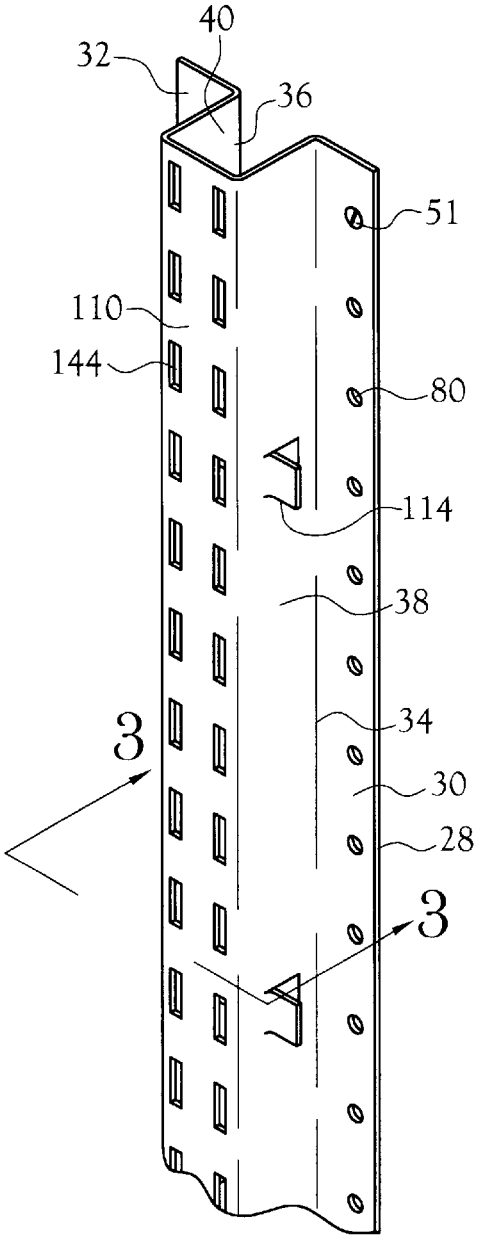
FIG. 2 is a representation of one embodiment of a standard useful in the present invention.
Figure 3:
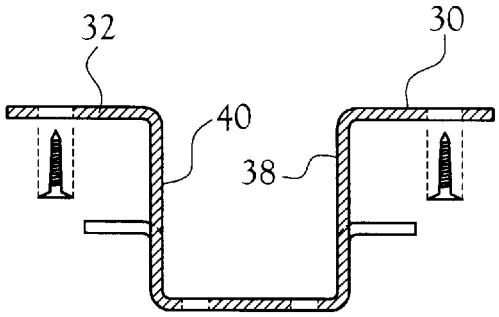
FIG. 3 is a cross-sectional view of the standard of FIG. 2 taken generally along the line 3—3 of FIG. 2.
Figure 4:
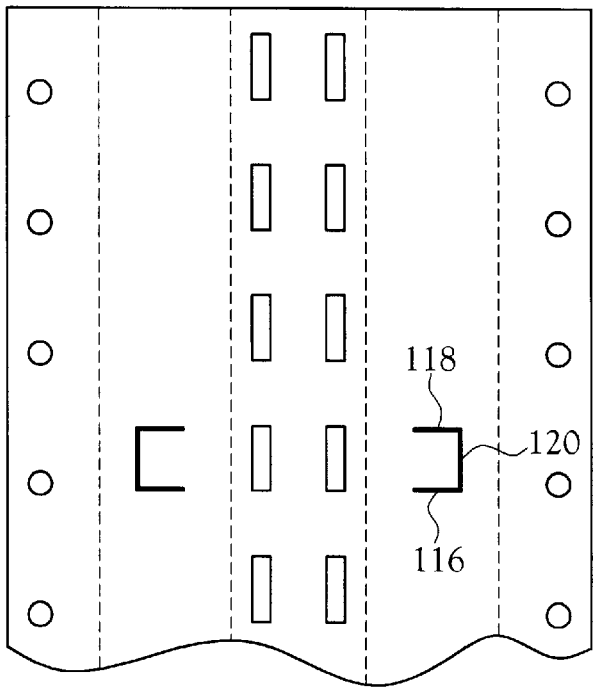
FIG. 4 is a laid out blank useful in the formation of the standard depicted in FIG. 2.

A preferred standard 28 for use in the present invention comprises a length of cold-rolled steel ribbon (14 gauge for example) that is die-formed into a U-shaped cross section having a face web 110. Referring specifically to FIGS. 2 and 4, each of the side margins 34,36 of the side webs 38,40 of the elongated standard transition into respective lateral wing webs 30,32. As noted above, the wing webs are provided with uniformly spaced holes through their thickness along their length. Morever, each of the side webs of each standard includes a plurality of lateral lugs 114 which are equally and uniformly spaced apart along the length of each side web 38,40. Referring to FIG. 4, each lug preferably is formed integrally with its side web as by cutting through the thickness of the side web along three sides 116,118,120 of a rectangular area of the side web and thereafter punching out the area within the cuts to define a rectangular lug 114 which is integral with its side web and projects laterally away from the side web and from the standard.

Between adjacent ones of the standards, the present wall system includes one or more removable panels 130 which are sized to substantially fill the area between adjacent ones of the standards of each set of standards and the floor rail and the top rail. To this end, there is provided a planar panel member 130 having a front surface 132 and a rear surface 134. Each side margin 136,138 of each panel is provided with a hook-shaped lug 140 which is adapted to engage one of the lugs 114 of a standard when the panel is disposed between adjacent standards, the lugs on one side of the panel engaging mating lugs on that standard adjacent such side of the panel as depicted in FIG. 7. Each panel member may extend either partially or substantially fully between the floor and top rails. Any spacing between adjacent ends of multiple panels and/or between the side edges of adjacent panels may include an appropriate reveal (not shown), as desired.

Within the face web 110 of each standard, optionally there is provided one or more vertical rows of horizontally and vertically spaced apart slots 144 which extend through the thickness of the face web and provide for the receipt and mounting therein of appropriate shelf brackets as are well known in the art. Appropriate shelving (not shown) may be placed upon and supported by the shelf brackets, also as well known in the art. It is noted that the presence of standards on opposite surfaces of the present wall system provides for the placement of shelving on either of both sides of the present wall system and at a large variety of permissible vertical spacing therebetween.

Figure 14:
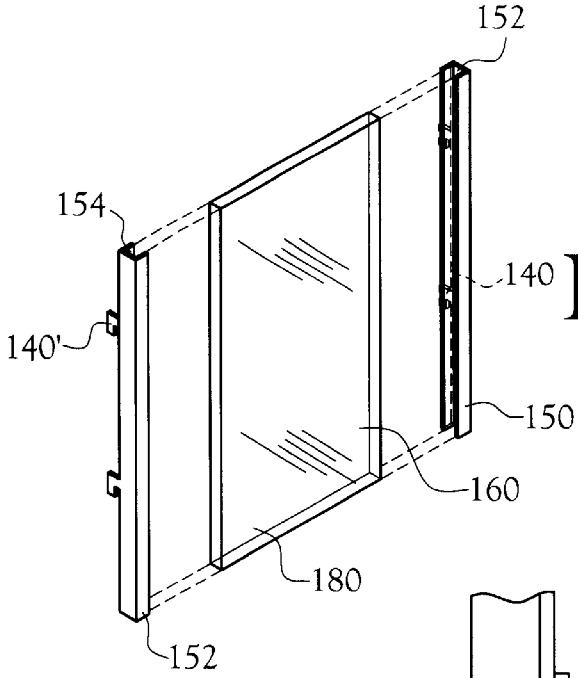
FIG. 14 is an exploded representation of an optional glass panel and mounting brackets for use in one embodiment of the present invention; and, FIG. 15 is a representation of a portion of one end of a free-standing panel wall system in accordance with one embodiment of the present invention, shown partly in section, and partly exploded and including one embodiment for attachment of a floor rail to a concrete floor.

Referring to FIG. 14, in one embodiment, the panel member may comprise a sheet of glass or a mirror 180, for example. Mounting of a glass panel between adjacent standards is provided for in the present invention through the means of first and second elongated narrow side brackets 150,152 each of which is provided with a plurality of hook-shaped lugs 140,140' adapted to removably interlock with respective ones of the lugs 114 on one of the adjacent standards. Each bracket 150,152 is of a generally U-shaped cross-section to define an open-sided channel 152,154 along its length. One side margin 160 of a glass panel is received in the channel 152 and the opposite side margin 162 of the glass panel is received in the channel 154, thereby providing for removable mounting of the glass panel between adjacent ones of the standards.

Figure 15:
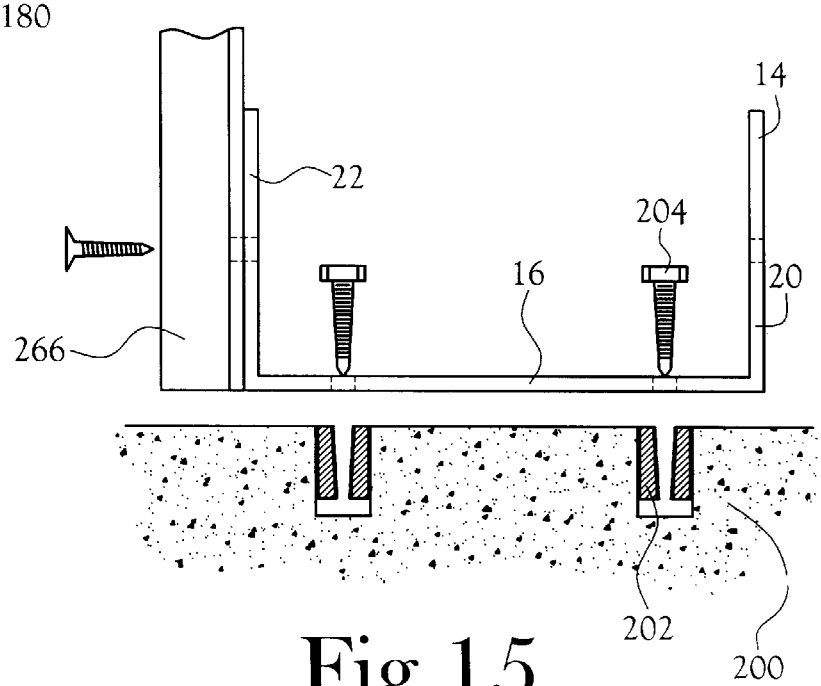

Referring specifically to FIG. 15, in one embodiment, the present panel wall system, may be anchored to a supporting floor 200 by means of conventional concrete anchors 202 embedded in the floor and which receive therein lag bolts 204 which extend through the thickness of the face web 16 of the floor rail 14. In one embodiment, the width of the face web of the floor rail may be between about 3 and about 12 inches. Preferably multiple concrete anchors and lag bolts are employed with respective ones of the anchors and lag bolts being located adjacent opposite ones of the side webs of the floor rail to thereby spaced the anchor locations for the floor rail to the floor laterally apart from one another as shown in FIG. 15. FIG. 15 further depicts one embodiment for removably attaching the bottom end 206 of a standard 28 to the upstanding side web 22 of the floor rail, such side web being between about 2 and about 3 inches in width. As desired, this side web 22 may be wider, to the extent that this web projects upwardly from the floor rail a greater distance to provide additional lateral anti-tipping support to the wall section. In FIG. 15, the bottom end of the standard is depicted as also resting on the surface of the floor, thereby adding to the stability of the free-standing panel wall system against lateral tipping (when viewed as in FIG. 15. On skilled in the art will recognize that other, equivalent, means may be employed for anchoring the present panel wall system of a floor. As noted hereinabove, when employing lateral wall sections, anchoring of the wall system to a floor frequently is not required.

As desired, the top ends of the standards and/or the top rail may be covered with an elongated cap 190 of generally U-shaped cross section such that the side webs 192,194 thereof depend alongside, and cover, the top ends of the standards on either or both faces of a wall section. In similar manner the distal ends 196 of the horizontal connector rails 52' may be covered with a cap 198.

Figure 16:
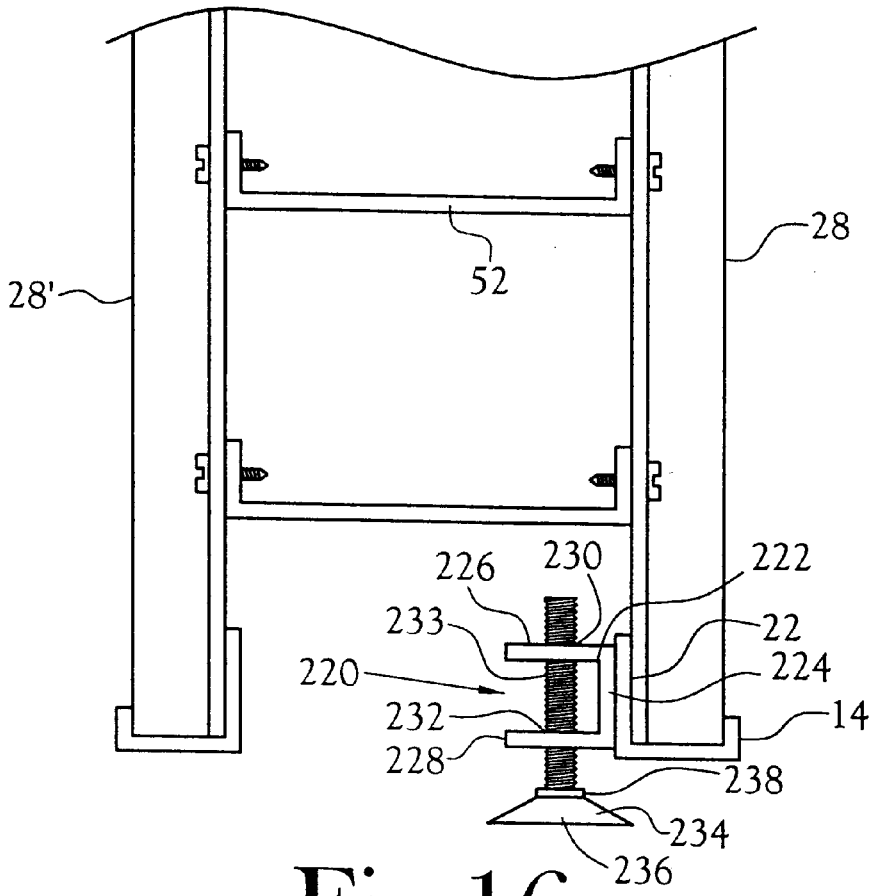
FIG. 16 is a representation of a panel wall system provided with leveling feet to allow for adjustment when the supporting floor is not truly horizontal.

In the course of installing a panel wall system of the present invention, a floor rail is initially anchored to the floor or other supporting surface. Where the floor is truly horizontal, the face web of the floor rail may be placed directly into contact with the top surface of the floor. In accordance with one aspect of the present invention, where the floor surface is not truly horizontal, the present inventor provides one or more leveling feet which are removably attached to one or both of the side webs of the floor rail. One such leveling foot 220 is depicted in FIG. 16 and includes a mounting bracket 222 having a base web 224 which is removably mounted to the side web 22 of a floor rail 14. This bracket is U-shaped in cross section and includes first and second side webs 226,228, each of which includes an internally threaded hole 230,232, respectively, through it thickness. The holes 230 and 232 are in register and threadably receive therethrough the threaded end 233 of a leveler foot 234 that comprises a circular flat foot member 236 having a hex-shaped portion 238 which is amenable to receipt of a wrench of the like for rotation of the foot member to increase or decrease the distance between the face web 16 of the bottom rail 14 and the floor. This embodiment of the present panel wall system is useful when installing a free-standing panel wall system having one or more lateral wall sections which can provide sufficient lateral anti-tipping support to the main wall section, and where the supporting floor is not truly horizontal.

Whereas the present invention has been described in specific terms and elements, it will be understood by one skilled in the art that equivalent elements, geometrical configurations, and other obvious modifications may be made without departing from the scope of the invention. For example, it will be recognized by one skilled in the art that any of several possible modes of releasably fastening the various components of the present wall system may be employed. Further, whereas steel metal, preferably 16 gauge cold rolled steel, is preferably employed as the material of construction for the various elements of the present wall system, other suitable, preferably non-combustible, materials may be employed. Accordingly, it is intended that the present invention be limited only as set forth in the claims appended hereto.

What is claimed is:

1. A free-standing panel wall system having front and rear faces and being useful for the display of merchandise in a retail establishment or other sales outlet comprising an elongated floor rail of generally U-shaped cross-section including a face web having opposite side margins and first and second side webs projecting generally perpendicularly from respective ones of said opposite side margins of said face web, each of said side webs including an outer face thereof, an elongated top rail of generally U-shaped cross-section including a face web having opposite side margins and first and second side webs projecting generally perpendicularly from respective ones of said opposite side margins of said face web, said floor rail and said top rail being substantially mirror images and being spaced apart from one another within a substantially vertical plane, each of said side webs including an outer face thereof, first and second sets of elongated standards, each set including a plurality of standards, each of which is of generally U-shaped cross-section including a generally planar face web having opposite side margins and first and second side webs projecting generally perpendicularly from respective ones of said side margins of said face web and defining respective distal edges thereof which transition into respective first and second opposite planar wings, each of said standards having a bottom end and a top end, said standards of said first set of standards being disposed on the front face of the panel wall system and said standards of said second set of standards being disposed on the rear face of the panel wall, said planar wings of each standard of each set of standards facing and overlying and being removably secured at their respective top and bottom ends to a respective one of said outer faces of said side webs of said floor rail and said top rail, a plurality of horizontal connector rails interposed between said first and second sets of standards at spaced-apart locations intermediate said floor rail and said top rail, each of said connector rails being of generally U-shaped cross-section including a face web having opposite side margins and first and second side webs projecting generally perpendicularly from respective ones of said opposite side margins of said face web, each of said side webs including an outer face thereof, said outer face of respective ones of said first and second side webs of said connector rails facing and overlying and being removably secured to respective ones of said side wings of respective ones of said sets of standards at their respective intersections with said standards, at least one substantially planar panel member removably interposed between adjacent ones of said standards.

2. The panel wall system of claim 1 and including at least one lug projecting from each of said side webs of each of said standards and at least one lug projecting from each of said panel members, said lugs being adapted to removably interlock and thereby retain said panel member removably between adjacent ones of said standards of a set of said standards.

3. The panel wall system of claim 1 wherein the sole securement for the panel against tipping from a vertical attitude of the assembled wall system comprises removable fasteners removably anchoring said floor rail to a floor.

4. The panel wall system of claim 1 in combination with a lateral panel wall section of substantially like construction as the panel wall system and having opposite ends, one of which is removably secured to one face of the panel wall system.

5. The panel wall system of claim 4 wherein said lateral panel wall section extends substantially perpendicularly from said panel wall system.

6. The panel wall system of claim 4 and including at least one connector bracket interlocking said lateral panel wall section with said panel wall system.

7. The panel wall system of claim 4 and including a connector bracket removably securing each of said top and bottom rails of said panel wall system with respective top and bottom rails of said lateral panel wall section.

8. The panel wall system of claim 6 wherein each of said connector brackets includes side webs which face and overlie respective ones of said side webs of said floor and top rails of said panel wall system and said lateral panel wall section, and including fasteners removably joining said facing and overlying side webs.

9. The panel wall system of claim 1 wherein said panel comprises a glass or mirror having opposite side margins, and including first and second elongated open-sided brackets defining respective open-sided channels, each of said channels receiving respective ones of said side margins of said panel, each of said brackets including lugs associated therewith which are removably interlockable with said lugs on respective ones of adjacent ones of said standards.

10. The panel wall system of claim 1 wherein each of said rails, standards, and panel is formed from a non-combustible material.

11. The panel wall system of claim 10 wherein said non-combustible material comprises cold-rolled steel.

12. The panel wall system of claim 11 wherein said cold-rolled steel is of 16 gauge.

* * * * *